US011965306B2

(12) United States Patent
Goldston

(10) Patent No.: US 11,965,306 B2
(45) Date of Patent: Apr. 23, 2024

(54) WINCH ANCHORING ASSEMBLY

(71) Applicant: Ronald Goldston, Parker, TX (US)

(72) Inventor: Ronald Goldston, Parker, TX (US)

( * ) Notice: Subject to any disclaimer, the term of this patent is extended or adjusted under 35 U.S.C. 154(b) by 100 days.

(21) Appl. No.: 17/562,147

(22) Filed: Dec. 27, 2021

(65) Prior Publication Data

US 2023/0203773 A1 Jun. 29, 2023

(51) Int. Cl.
*E02D 5/80* (2006.01)
*E02D 27/50* (2006.01)
*E02D 29/02* (2006.01)

(52) U.S. Cl.
CPC ..... *E02D 5/80* (2013.01); *E02D 27/50* (2013.01); *E02D 29/0233* (2013.01); *E02D 2600/30* (2013.01)

(58) Field of Classification Search
CPC ..... E02D 5/80; E02D 27/50; E02D 2600/30; E02D 17/20; E02D 29/0233; B63B 21/44; E01D 19/14; E04H 15/62
See application file for complete search history.

(56) References Cited

U.S. PATENT DOCUMENTS 729,591 A * 6/1903 Jacob ..... E01D 19/14 52/155
1,316,323 A * 9/1919 Poole ..... E02D 5/80 52/155
1,721,436 A * 7/1929 Dubois ..... E02D 5/80 52/158
2,490,423 A * 12/1949 Fearn ..... B63B 21/44 114/310
2,870,884 A * 1/1959 Mazur ..... E02D 5/80 52/158
3,022,761 A * 2/1962 Philip ..... B63B 21/38 114/306
4,315,387 A * 2/1982 Lee ..... E02D 5/80 52/156
4,778,126 A 10/1988 Spann, Jr.
5,437,128 A 8/1995 Gremillion
6,564,515 B1 5/2003 Fontenot
7,047,696 B2 * 5/2006 DiDomenico ..... E02D 5/80 52/156

(Continued)

FOREIGN PATENT DOCUMENTS

FR 1403629 * 7/1963
GB 2395727 6/2004
WO WO2008115078 9/2008

*Primary Examiner* — Brian D Mattei
*Assistant Examiner* — Omar F Hijaz

(57) ABSTRACT

A winch anchoring assembly includes rack has an anchor portion and an attachment portion. The attachment portion has a first engagement that is attachable to a winch line of a vehicle. A plurality of spikes is coupled to and extends downwardly from a respective one of the anchor portion and the attachment portion of the rack. Each of the spikes is oriented to angle forwardly toward the first engagement on the attachment portion. In this way the spikes sink into the ground when the winch line pulls on the first engagement thereby facilitating the rack to resist being pulled out of the ground when the winch line is pulling the vehicle. A second engagement is coupled to the anchor portion of the rack and an anchoring line can attached to the second engagement thereby inhibiting movement of the rack when the which line pulls on the rack.

6 Claims, 6 Drawing Sheets

(56) References Cited

U.S. PATENT DOCUMENTS

| | | | | |
|---|---|---|---|---|
| 7,603,818 | B2 | 10/2009 | Guthrie | |
| 7,887,263 | B2 | 2/2011 | Moffat | |
| 8,312,680 | B2 * | 11/2012 | Krahn | E02D 5/80 52/155 |
| 9,133,594 | B2 * | 9/2015 | Hurley | E02D 5/80 |
| 2005/0000170 | A1 * | 1/2005 | DiDomenico | E02D 5/80 52/169.9 |
| 2005/0161652 | A1 | 7/2005 | Morgan | |
| 2006/0245874 | A1 | 11/2006 | Linnen | |
| 2007/0181171 | A1 * | 8/2007 | Roberts | E04H 15/62 135/118 |
| 2010/0223862 | A1 | 9/2010 | Smit | |

* cited by examiner

WINCH ANCHORING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to anchoring device and more particularly pertains to a new anchoring device for facilitating a secure anchor point for a winch on a vehicle. The device includes a rack that has a plurality of spikes angling downwardly from the rack. The rack includes an engagement that is attachable to a winch line of a vehicle. The spikes sink into the ground when the winch line pulls on the rack thereby facilitating the winch to pull the vehicle out of an area in which the vehicle has become stuck.

(2) Description of Related Art Including Information Disclosed Under 37 CFR 1.97 and 1.98

The prior art relates to anchoring devices including a vehicle winch device that includes a threaded anchor for penetrating the ground and a pulley that is attachable to a wheel of a vehicle. The prior art discloses a variety of land anchors which each includes an angled frame and a prow attached to the angled frame. The prow penetrates the ground when the angled frame is drawn by a winch line of a vehicle. The prior art discloses a variety of land anchor devices that each at least includes a threaded screw which penetrates ground for anchoring a winch line of a vehicle. The prior art discloses a winch anchor that includes a spike for penetrating ground and a pair of wings extending away from the spike for laterally stabilizing the spike when a winch line is attached to the spike.

BRIEF SUMMARY OF THE INVENTION

An embodiment of the disclosure meets the needs presented above by generally comprising a rack has an anchor portion and an attachment portion. The attachment portion has a first engagement that is attachable to a winch line of a vehicle. A plurality of spikes is coupled to and extends downwardly from a respective one of the anchor portion and the attachment portion of the rack. Each of the spikes is oriented to angle forwardly toward the first engagement on the attachment portion. In this way the spikes sink into the ground when the winch line pulls on the first engagement thereby facilitating the rack to resist being pulled out of the ground when the winch line is pulling the vehicle. A second engagement is coupled to the anchor portion of the rack and an anchoring line can attached to the second engagement thereby inhibiting movement of the rack when the which line pulls on the rack.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
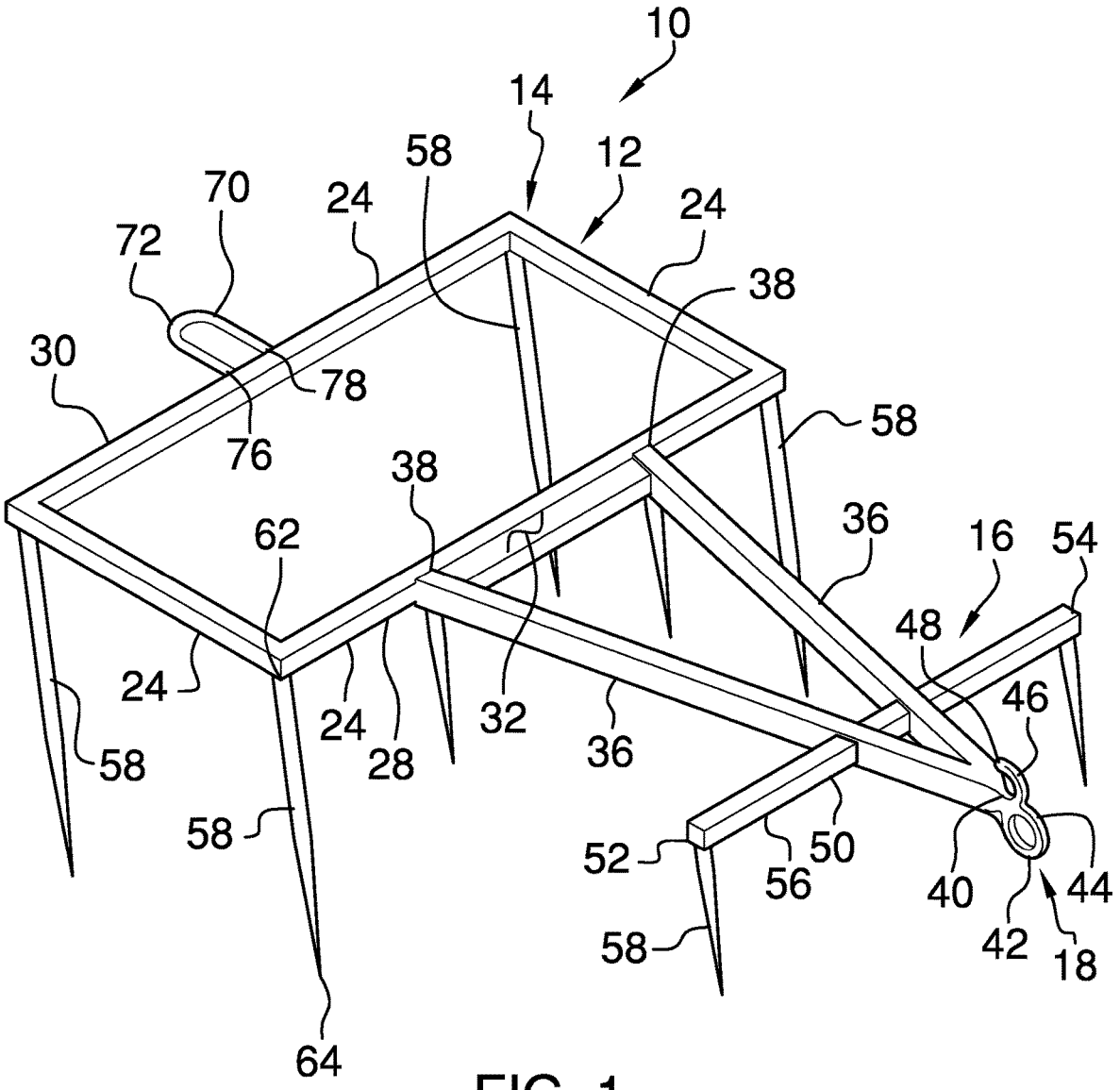
FIG. 1 is a top perspective view of a winch anchoring assembly according to an embodiment of the disclosure.
Figure 2:
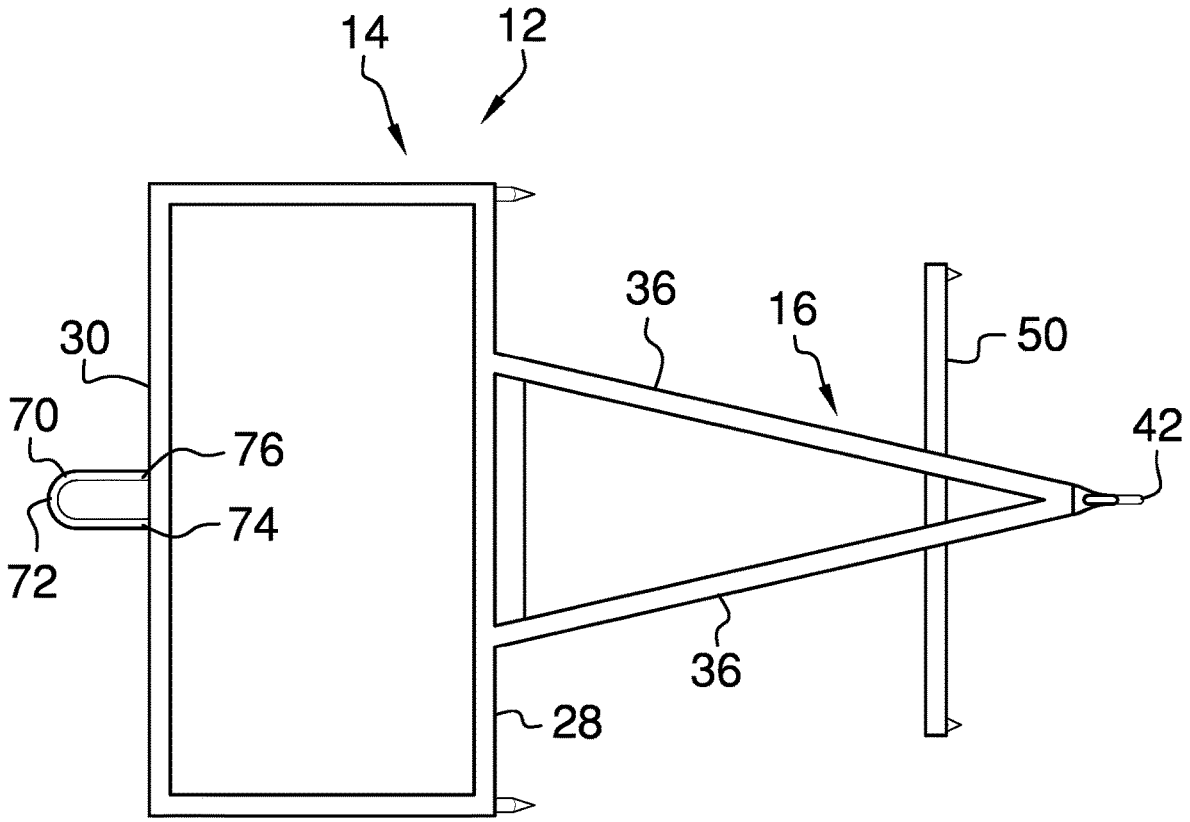
FIG. 2 is a top view of an embodiment of the disclosure.
Figure 3:
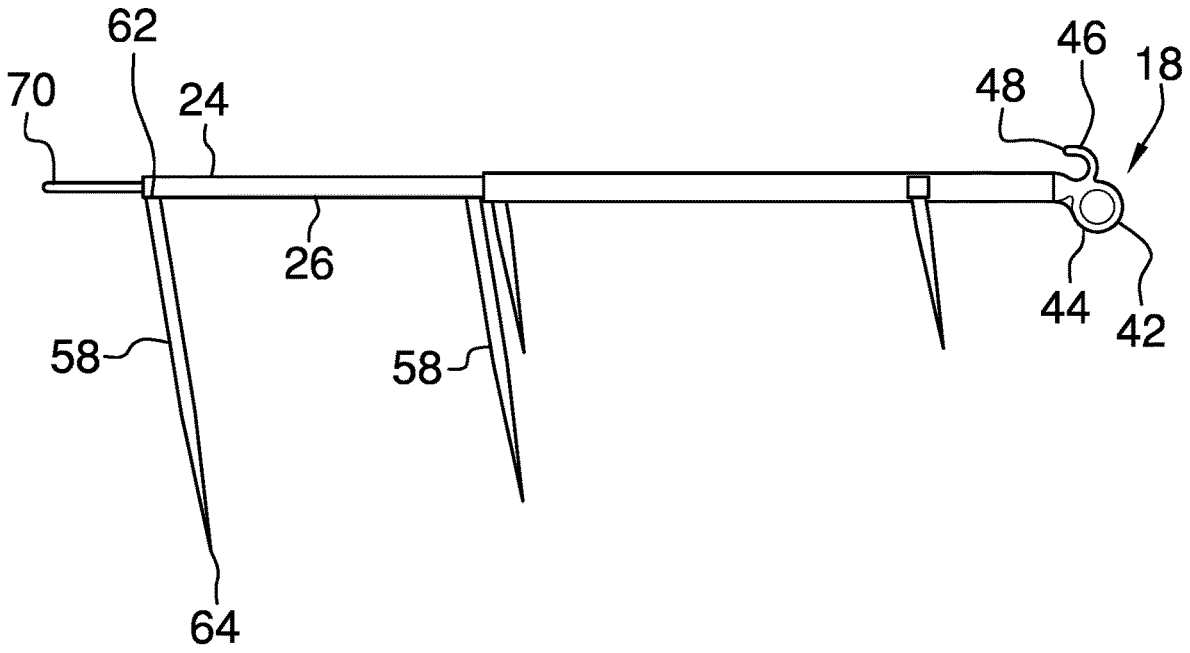
FIG. 3 is a right side view of an embodiment of the disclosure.
Figure 4:
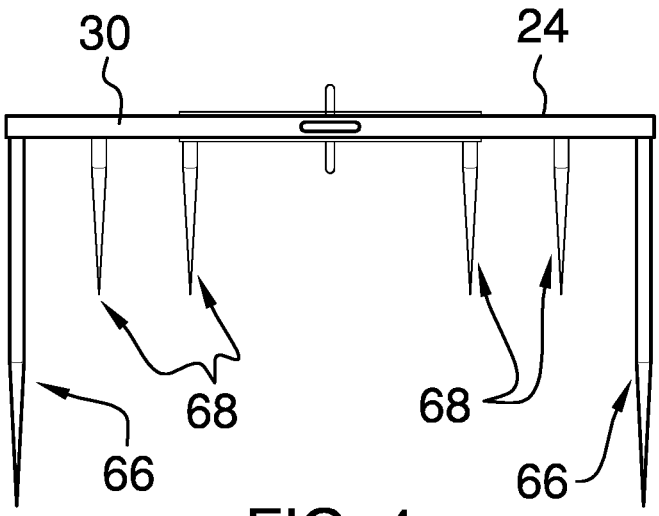
FIG. 4 is a back view of an embodiment of the disclosure.
Figure 5:
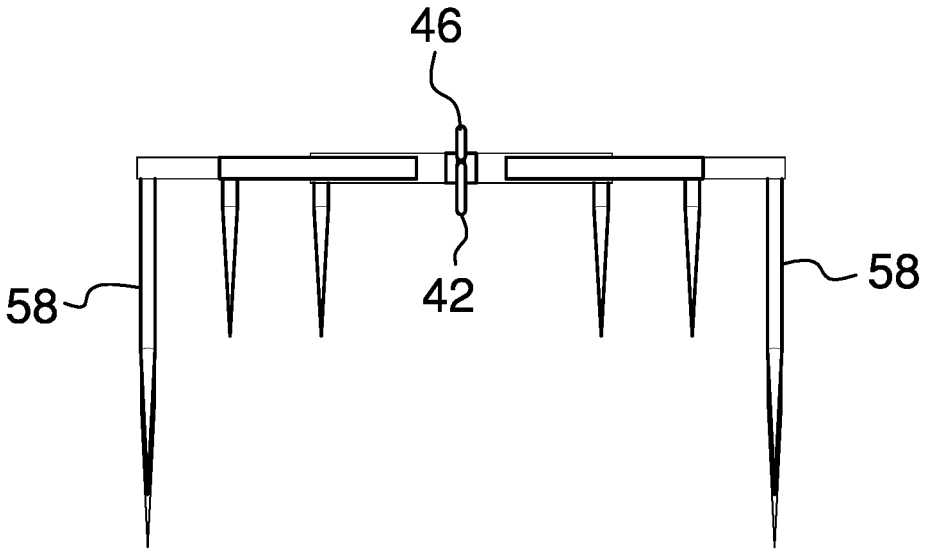
FIG. 5 is a front view of an embodiment of the disclosure.
Figure 6:
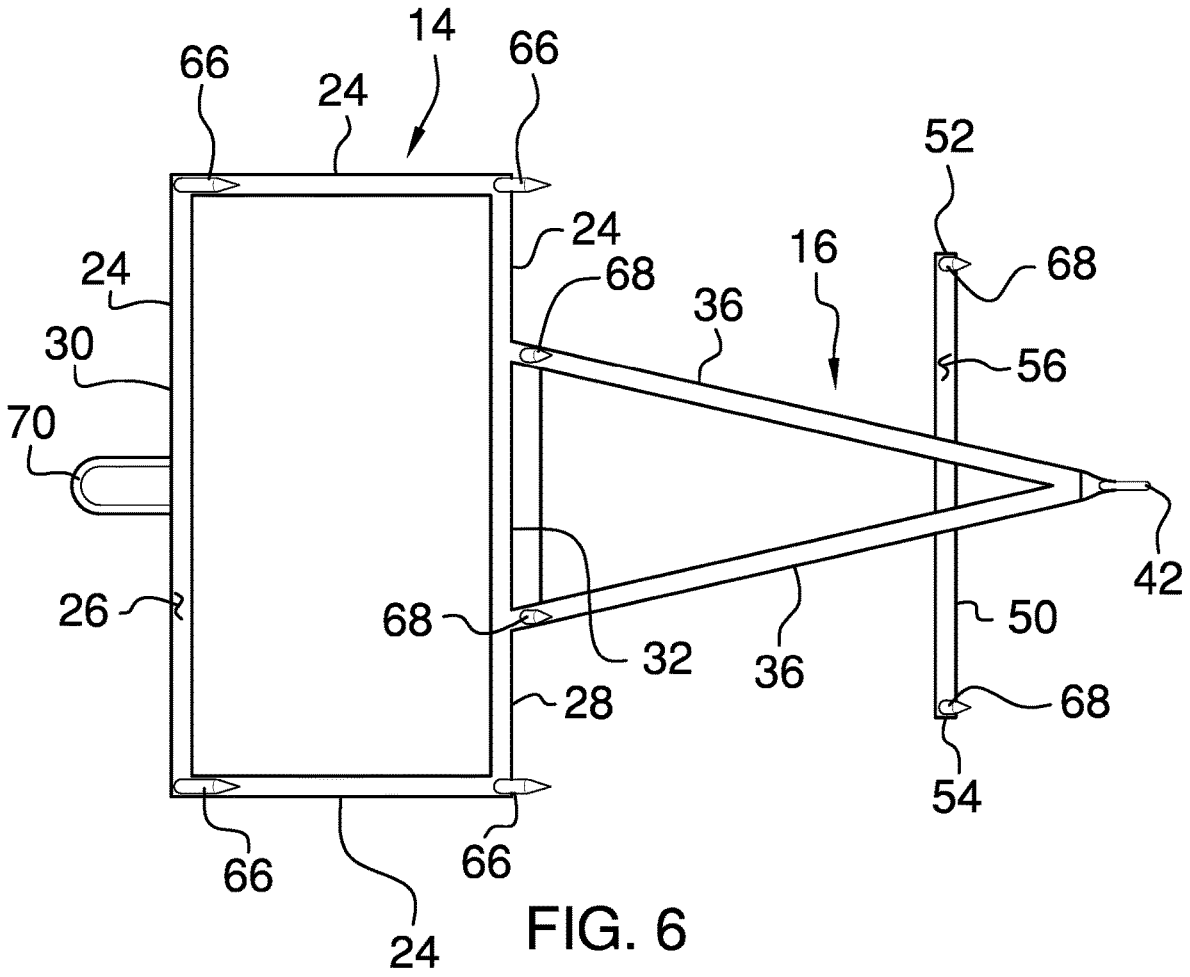
FIG. 6 is a bottom view of an embodiment of the disclosure.
Figure 7:
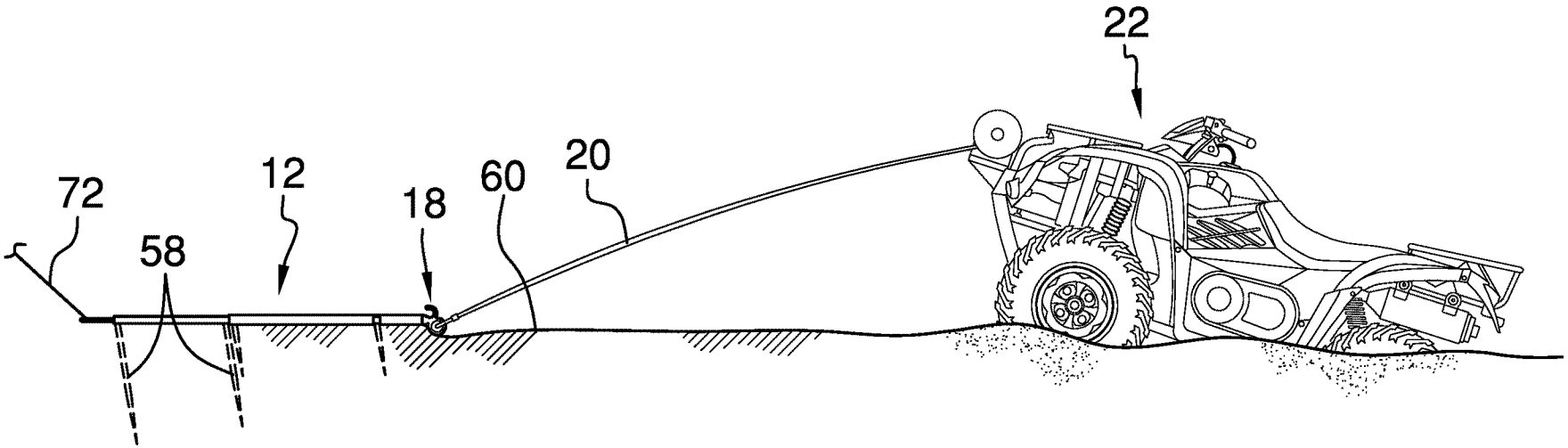
FIG. 7 is a perspective in-use view of an embodiment of the disclosure.

With reference now to the drawings, and in particular to FIGS. 1 through 7 thereof, a new anchoring device embodying the principles and concepts of an embodiment of the disclosure and generally designated by the reference numeral 10 will be described.

As best illustrated in FIGS. 1 through 7, the winch anchoring assembly 10 generally comprises a rack 12 that has an anchor portion 14 and an attachment portion 16 extending forwardly from the anchor portion 14. The attachment portion 16 has a first engagement 18 which is integrated into the attachment portion 16 and the first engagement 18 is attachable to a winch line 20 of a vehicle 22. The anchor portion 14 comprises a plurality of anchor members 24 which intersects each other at a right angle such that the anchor portion 14 has a rectangular shape. Each of the anchor members 24 has a bottom surface 26 and the plurality of anchor members 24 includes a front anchor member 28 and a rear anchor member 30. The winch line 20 may be associated with a winch on a vehicle 22 that has become stuck, such as an all-terrain vehicle, an off road vehicle or any other type of motorized vehicle that employs a winch.

The front anchor member 28 has a front surface 32 and the rear anchor member 30 has a rear surface 34. The attachment portion 16 includes a pair of first attachment members 36 and each of the first attachment members 36 has a first end 38 and a second end 40. The first end 38 is coupled to the front surface 32 of the front anchor member 28. The second end 40 of each of the first attachment members 36 is coupled together such that the first attachment members 36 tapers to a point at the second end 40 of the first attachment members 36.

The first engagement 18 comprises a ring 42 that has an outer edge 44, and the outer edge 44 is coupled to the point defined by the second end 40 of the pair of first attachment members 36. The first engagement 18 includes a hook 46 that is coupled to and extends upwardly from the outer edge 44 of the ring 42. The hook 46 has a distal end 48 with respect to the outer edge 44. The hook 46 is curved between the ring 42 and the distal end 48 such that the hook 46 curves toward the anchor portion 14.

The attachment portion 16 includes a second attachment member 50 that has a primary end 52 and a secondary end 54. The second attachment member 50 extends laterally across each of the first attachment members 36 such that each of the primary end 52 and the secondary end 54 is spaced outwardly from a respective one of the first attachment members 36. The second attachment member 50 extends along an axis that is oriented parallel to a longitudinal axis of the front anchor member 28. The second attachment member 50 is positioned at a point that is located adjacent to the second end 40 of the first attachment members 36, and the second attachment member 50 has a lower surface 56.

A plurality of spikes 58 is provided and each of the spikes 58 is coupled to and extends downwardly from a respective one of the anchor portion 14 and the attachment portion 16 of the rack 12. In this way each of the spikes 58 can penetrate the ground 60 when the rack 12 is positioned on the ground 60. Each of the spikes 58 is oriented to angle forwardly toward the first engagement 18 on the attachment portion 16. In this way each of the spikes 58 can sink into the ground 60 when the winch line 20 pulls on the first engagement 18. Thus, the rack 12 can resist being pulled out of the ground 60 when the winch line 20 is pulling the vehicle 22.

Each of the spikes 58 has a coupled end 62 and a free end 64, and each of the spikes 58 tapers to a point at the free end 64. The plurality of spikes 58 includes a set of first spikes 66 and a set of second spikes 68. Each of the first spikes 66 has a length that is greater than the length of the second spikes 68. The coupled end 62 of each of the first spikes 66 is coupled to the bottom surface 26 of a respective one of the anchor members 24. Each of the first spikes 66 is positioned adjacent to an intersection of a respective pair of the anchor members 24. The coupled end 62 of respective ones of the second spikes 68 is coupled to the lower surface 56 of the second attachment member 50. Each of the second spikes 68 on the second attachment member 50 is positioned adjacent to a respective one of the primary end 52 and the secondary end 54 of the second attachment member 50.

A second engagement 70 is coupled to the anchor portion 14 of the rack 12 and an anchoring line 72 can be attached to the second engagement 70 thereby inhibiting movement of the rack 12 when the which line pulls on the rack 12. The second engagement 70 comprises a rod 74 which has a first end 76 and a second end 78, and the rod 74 is curved between the first end 76 and the second end 78 of the rod 74 such that the rod 74 has a U-shape. Furthermore, each of the first end 76 and the second end 78 of the rod 74 is coupled to a rear surface 80 of the rear anchor member 30.

In use, the rack 12 is laid on the ground 60 in front of the vehicle 22 such that the first engagement 18 is directed toward the vehicle 22. The winch line 20 is attached to the first engagement 18 and the winch is turned on. Furthermore, each of the spikes 58 is urged downwardly into the ground 60 when the winch line 20 pulls on the rack 12. In this way the rack 12 facilitates a secure anchor point for the winch to pull the vehicle 22 out of a ditch, for example, or other location in which the vehicle 22 has become stuck. Thus, the rack 12 facilitates a secure anchor point for the winch in almost any location.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A winch anchoring assembly for facilitating an anchor point for winching a vehicle out of an area in which the vehicle is stuck, said assembly comprising:

a rack having an anchor portion and an attachment portion extending forwardly from said anchor portion, said attachment portion having a first engagement being integrated into said attachment portion, said first engagement being attachable to a winch line of a vehicle, said anchor portion comprises a plurality of anchor members intersecting each other at a right angle such that said anchor portion has a rectangular shape, each of said anchor members having a bottom surface, said plurality of anchor members including a front anchor member and a rear anchor member, said front anchor member having a front surface, said rear anchor member having a rear surface;

a plurality of spikes, each of said spikes being coupled to and extending downwardly from a respective one of said anchor portion and said attachment portion of said rack wherein each of said spikes is configured to penetrate into the ground when said rack is positioned on the ground, each of said spikes being oriented to angle forwardly toward said first engagement on said attachment portion wherein each of said spikes is configured to sink into the ground when the winch line pulls on said first engagement thereby facilitating said rack to resist being pulled out of the ground when the winch line is pulling the vehicle;

a second engagement being coupled to said anchor portion of said rack wherein said second engagement is configured to have an anchoring line being attached to said second engagement thereby inhibiting movement of said rack when the winch line pulls on said rack, wherein said second engagement comprises a rod having a first end and a second end, said rod being curved between said first end and said second end of said rod such that said rod has a U-shape, each of said first end and said second end of said rod being coupled to said rear surface of said rear anchor member wherein parallel straight portions of said second engagement extend perpendicularly from said rear surface of said rear anchor member coplanar with said rack;

wherein said attachment portion includes a pair of first attachment members, each of said first attachment members having a first end and a second end, said first end being coupled to said front surface of said front anchor member, said second end of each of said first attachment members being coupled together such that said first attachment members tapers to a point at said second end of said first attachment members; and wherein said attachment portion includes a second attachment member having a primary end and a secondary end, said second attachment member extending laterally across each of said first attachment members such that each of said primary end and said secondary end is spaced outwardly from a respective one of said first attachment members, said second attachment member extending along an axis being oriented parallel to a longitudinal axis of said front anchor member, said second attachment member being positioned at a point being located adjacent to said second end of said first attachment members, said second attachment member having a lower surface.

2. The assembly according to claim 1, wherein said first engagement comprises a ring having an outer edge, said outer edge being coupled to said point defined by said second end of said pair of first attachment members.

3. The assembly according to claim 1, wherein:

each of said spikes has a coupled end and a free end, each of said spikes tapering to a point at said free end;

said plurality of spikes includes a set of first spikes and a set of second spikes; and said coupled end of each of said first spikes being coupled to said bottom surface of a respective one of said anchor members, each of said first spikes being positioned adjacent to an intersection of a respective pair of said anchor members.

4. The assembly according to claim 1, wherein:

each of said spikes has a coupled end and a free end, each of said spikes tapering to a point at said free end;

said plurality of spikes includes a set of first spikes and a set of second spikes; and said coupled end of each of said second spikes is coupled to said lower surface of said second attachment member, each of said second spikes being positioned adjacent to a respective one of said primary end and said secondary end of said second attachment member.

5. A winch anchoring assembly for facilitating an anchor point for winching a vehicle out of an area in which the vehicle is stuck, said assembly comprising:

a rack having an anchor portion and an attachment portion extending forwardly from said anchor portion, said attachment portion having a first engagement being integrated into said attachment portion, said first engagement being attachable to a winch line of a vehicle, said anchor portion comprises a plurality of anchor members intersecting each other at a right angle such that said anchor portion has a rectangular shape, each of said anchor members having a bottom surface, said plurality of anchor members including a front anchor member and a rear anchor member, said front anchor member having a front surface, said rear anchor member having a rear surface;

a plurality of spikes, each of said spikes being coupled to and extending downwardly from a respective one of said anchor portion and said attachment portion of said rack wherein each of said spikes is configured to penetrate into the ground when said rack is positioned on the ground, each of said spikes being oriented to angle forwardly toward said first engagement on said attachment portion wherein each of said spikes is configured to sink into the ground when the winch line pulls on said first engagement thereby facilitating said rack to resist being pulled out of the ground when the winch line is pulling the vehicle; and a second engagement being coupled to said anchor portion of said rack wherein said second engagement is configured to have an anchoring line being attached to said second engagement thereby inhibiting movement of said rack when the winch line pulls on said rack, wherein said second engagement comprises a rod having a first end and a second end, said rod being curved between said first end and said second end of said rod such that said rod has a U-shape, each of said first end and said second end of said rod being coupled to said rear surface of said rear anchor member wherein parallel straight portions of said second engagement extend perpendicularly from said rear surface of said rear anchor member coplanar with said rack;

wherein said attachment portion includes a pair of first attachment members, each of said first attachment members having a first end and a second end, said first end being coupled to said front surface of said front anchor member, said second end of each of said first attachment members being coupled together such that said first attachment members tapers to a point at said second end of said first attachment members;

wherein said first engagement comprises a ring having an outer edge, said outer edge being coupled to said point defined by said second end of said pair of first attachment members; and wherein said first engagement includes a hook being coupled to and extending upwardly from said outer edge of said ring, said hook having a distal end with respect to said outer edge, said hook being curved between said ring and said distal end such that said hook curves toward said anchor portion.

6. A winch anchoring assembly for facilitating an anchor point for winching a vehicle out of an area in which the vehicle is stuck, said assembly comprising:

a rack having an anchor portion and an attachment portion extending forwardly from said anchor portion, said attachment portion having a first engagement being integrated into said attachment portion, said first engagement being attachable to a winch line of a vehicle, said anchor portion comprising a plurality of anchor members intersecting each other at a right angle such that said anchor portion has a rectangular shape, each of said anchor members having a bottom surface, said plurality of anchor members including a front anchor member and a rear anchor member, said front anchor member having a front surface, said rear anchor member having a rear surface, said attachment portion including a pair of first attachment members, each of said first attachment members having a first end and a second end, said first end being coupled to said front surface of said front anchor member, said second end of each of said first attachment members being coupled together such that said first attachment members tapers to a point at said second end of said first attachment members, said first engagement comprising a ring having an outer edge, said outer edge being coupled to said point defined by said second end of said pair of first attachment members, said first engagement including a hook being coupled to and extending upwardly from said outer edge of said ring, said hook having a distal end with respect to said outer edge, said hook being curved between said ring and said distal end such that said hook curves toward said anchor portion, said attachment portion including a second attachment member having a primary end and a secondary end, said second attachment member extending laterally across each of said first attachment members such that each of said primary end and said secondary end is spaced outwardly from a respective one of said first attachment members, said second attachment member extending along an axis being oriented parallel to a longitudinal axis of said front anchor member, said second attachment member being positioned at a point being located adjacent to said second end of said first attachment members, said second attachment member having a lower surface;

a plurality of spikes, each of said spikes being coupled to and extending downwardly from a respective one of said anchor portion and said attachment portion of said rack wherein each of said spikes is configured to penetrate into the ground when said rack is positioned on the ground, each of said spikes being oriented to angle forwardly toward said first engagement on said attachment portion wherein each of said spikes is configured to sink into the ground when the winch line pulls on said first engagement thereby facilitating said rack to resist being pulled out of the ground when the winch line is pulling the vehicle, each of said spikes having a coupled end and a free end, each of said spikes tapering to a point at said free end, said plurality of spikes including a set of first spikes and a set of second spikes, said coupled end of each of said first spikes being coupled to said bottom surface of a respective one of said anchor members, each of said first spikes being positioned adjacent to an intersection of a respective pair of said anchor members, said coupled end of each of said second spikes being coupled to said lower surface of said second attachment member, each of said second spikes being positioned adjacent to a respective one of said primary end and said secondary end of said second attachment member; and a second engagement being coupled to said anchor portion of said rack wherein said second engagement is configured to have an anchoring line being attached to said second engagement thereby inhibiting movement of said rack when the which line pulls on said rack, said second engagement comprising a rod having a first end and a second end, said rod being curved between said first end and said second end of said rod such that said rod has a U-shape, each of said first end and said second end of said rod being coupled to a rear surface of said rear anchor member wherein parallel straight portions of said second engagement extend perpendicularly from said rear surface of said rear anchor member coplanar with said rack.

* * * * *